US005092239A

United States Patent [19]

Bubley

[11] Patent Number: 5,092,239

[45] **Date of Patent: * Mar. 3, 1992**

[54] VACUUM DISTRIBUTION APPARATUS AND METHOD FOR FLAT BED SCREEN PRINTING PRESS

[76] Inventor: Henry J. Bubley, 1125 Heather Rd., Deerfield, Ill. 60015

[ * ] Notice: The portion of the term of this patent subsequent to Mar. 20, 2007 has been disclaimed.

[21] Appl. No.: 522,388

[22] Filed: May 11, 1990

[51] Int. Cl.[5] ..... B41F 15/10; B41F 15/20

[52] U.S. Cl. ..... 101/115; 198/471.1

[58] Field of Search ..... 198/471.1, 803.5, 689.1; 101/115, 126, 129

[56] References Cited

U.S. PATENT DOCUMENTS

| | | | |
|---|---|---|---|
| 3,070,212 | 12/1962 | Shabram | 198/471.1 X |
| 3,124,065 | 3/1964 | Bozek et al. | 198/471.1 X |
| 3,592,320 | 7/1971 | Binggeli | 198/471.1 X |
| 3,616,942 | 11/1971 | Gruber | 198/471.1 X |
| 4,753,162 | 6/1988 | Bubley | 101/115 |
| 4,909,142 | 3/1990 | Bubley | 101/115 |

*Primary Examiner*—Clifford D. Crowder
*Attorney, Agent, or Firm*—Fitch, Even, Tabin & Flannery

[57] ABSTRACT

Screen printing apparatus having an inner stationary column having a vertical axis and an outer rotatable cylinder encircling the column and rotatable about the vertical axis. A rotatable turntable is mounted on the rotatable cylinder for movement between successive screen printing stations. The turntable mounts plural work supports having vacuum beds to retain workpieces. A vacuum ring is connected to a stationary vacuum means and has a slidable sealed contacting surface with the turntable to transfer vacuum to a plurality of conduits extending to each work support.

3 Claims, 3 Drawing Sheets

FIG. 4
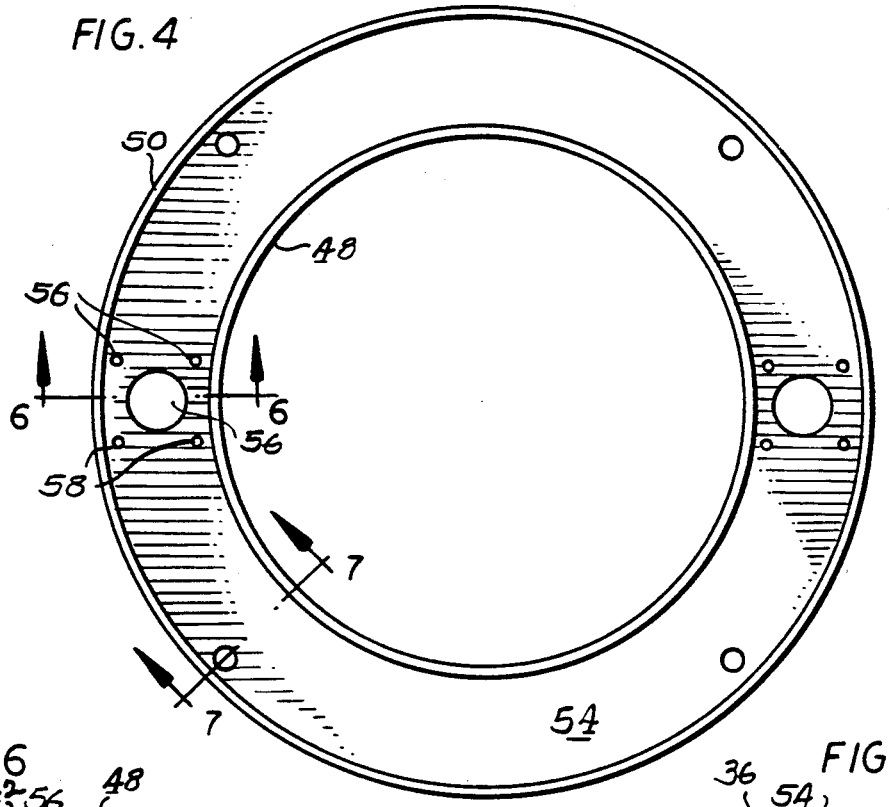
FIG. 6
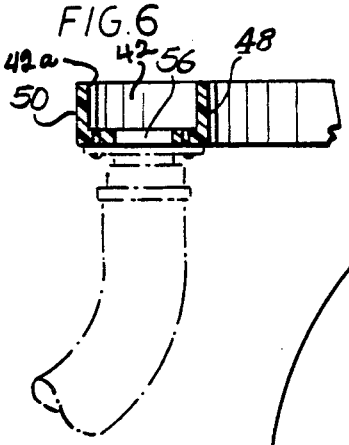
FIG. 7
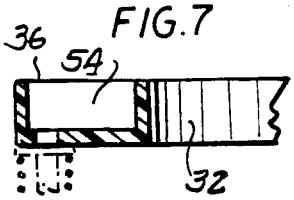
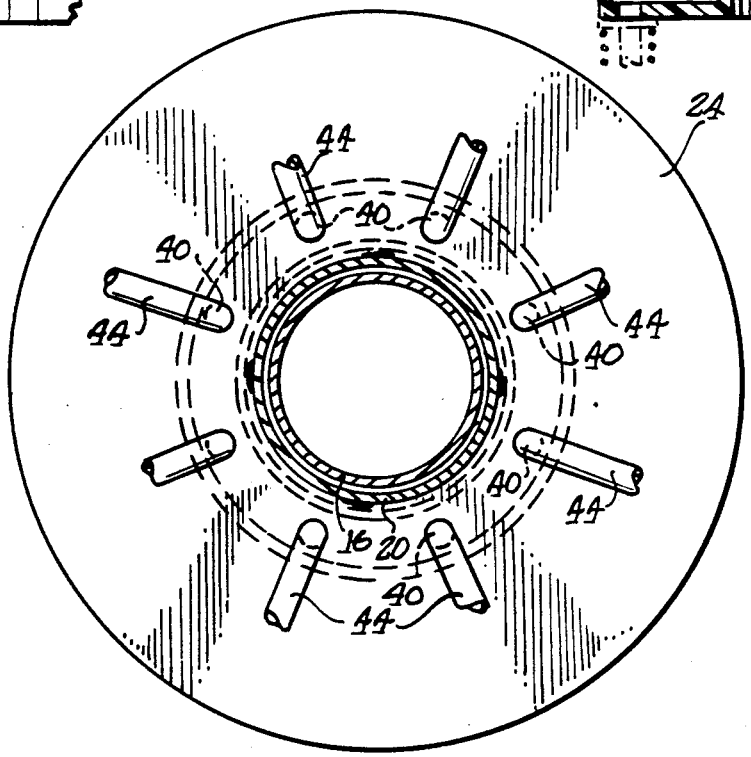
FIG. 5

VACUUM DISTRIBUTION APPARATUS AND METHOD FOR FLAT BED SCREEN PRINTING PRESS

BACKGROUND OF THE INVENTION

1. Field of the Invention

This invention relates to a screen printing apparatus and method for distributing a vacuum, and more particularly, to a method and apparatus for distributing a vacuum to each of a plurality of vacuum beds arranged about the periphery of a rotatable turntable to retain articles to be printed during a multicolor, screen printing operation.

2. Description of Related Art

It is well known in the art of screen printing to print multicolored images on an article retained by a vacuum on a work carrier or platen and sequentially carrying the article to each of a plurality of print units, located peripherally about a central support, wherein each print unit prints a different color. The images printed at the several print units, when superimposed one over the other on the material, produce the desired multicolored work. It is important in multicolored apparatus of this type to retain the material to be printed at an exact and precise stationary location on the work carrier, which in the case of sheets or textiles is a flat bed or platen as the flat bed rotates to the various printing units. This is assists in the registration of the various separately colored images in relation to one another as the material undergoes its multiple printing operations, thus assuring accurately registered color imprints to form a composite image.

Earlier flat bed screen printing presses provided a single rotatable central turntable or cylinder supporting a turntable with flat beds mounted about its periphery for rotational movement with the rotating cylinder about the vertical axis of the support cylinder, wherein each bed carried a material to be printed to each of a plurality of free-standing, screen print units which were located peripherally about the turntable. That is, the screen printers were standing alone and were mounted on the floor at locations radially outward of the turntable which carried a series of circumferentially-spaced flat beds and intermittently shifted each flat bed, with its associated material mounted thereto, into a registration position beneath each of the free-standing printing units.

The material was retained in a stationary position on the flat bed by utilization of a vacuum. A single rotating central support column or cylinder supported the horizontally-mounted turntable and its flat beds. At a lower location on the rotating cylinder, a plurality of circumferentially-spaced holes were made through the wall of the support cylinder. A stationary, annular vacuum ring encircled the support cylinder about the lower holes, forming a slidable airtight seal with the rotating support cylinder. A vacuum pump was attached to the vacuum ring which induced vacuum pressure in the vacuum ring which, in turn, induced vacuum pressure in the hollow interior of the rotating support cylinder. A plurality of holes were formed in the hollow cylinder at the turntable and a plenum ring on the turntable was connected to a series of vacuum conduits leading from this turntable plenum to the vacuum beds. Reduced pressure, i.e., the vacuum was thereby transferred from the rotating plenum portion of the turntable to the underside of the flat beds, thereby providing the desired vacuum beds for securing materials thereon.

Later, as disclosed in U.S. Pat. No. 4,909,142, it was found desirable to support the multiple printing units on the central support instead of having them free-standing on the floor. The printing units are very heavy and large machines having their separate motors, printing head lift mechanisms, and squeegee and flood bar actuating mechanisms. In order to support the heavy vertical load of these printing units, two concentric vertical support shafts or cylinders were employed in these presses. An inner stationary shaft supported the printing units, and a lower cylinder or sleeve rotatably mounted on a bearing supported the turntable with its associated flat beds.

The above-described system for applying a suction plenum between an inner shaft and an outer shaft could not be used because there is a loss of vacuum pressure through the lower bearing on which the outer rotating sleeve is supported for rotational movement. The bearing extends beneath the lower sleeve, from outside the lower sleeve into the region between concentric cylinders. The bearing is not airtight but rather, allows air to pass therethrough between adjacent ball bearings. Thus, there is a loss of vacuum pressure from the region between the two concentric cylinders through the bearing. Therefore, there is a need to find means for distributing vacuum pressure in which the bearing is not required to seal the vacuum pressure.

Another shortcoming of prior art designs is that cracks in any portion of the rotating plenum portion of the turntable result in loss of vacuum pressure. The turntable supports the heavy load of the multiple, flat bed presses affixed about the periphery thereof. Since the centermost portion of the turntable is hollow there is, accordingly, a substantially reduced cross-sectional area of the turntable which must support the load. This reduced turntable thickness, combined with the rapid rotation of the turntable and the repetitive forces to the flat beds upon printing, increases the likelihood of stress cracks developing in this region. Therefore, there is a need to eliminate the requirement of a rotating, plenum portion of the turntable.

Similarly, any cracks in either of the concentric, central cylinders results in loss of vacuum pressure. Like the turntable discussed above, the central support columns are required to support heavy loads with repetitive forces imparted thereto during printing operations; thus, there is a substantial likelihood of stress or fatigue cracks developing in the columns. Therefore, there is a need to eliminate the utilization of the central support cylinders for distributing vacuum pressure.

Lastly, it has been found to be difficult to maintain an airtight seal between the stationary vacuum ring and the rotating central cylinder. Cylinders have been found not to have perfectly circular cross-sections. Such noncircularity results in gaps between the vacuum ring and the cylinder which allows the passage of air therethrough causing, a loss of vacuum pressure. Therefore, there is a need to eliminate the requirement of airtight seals with the central cylinder.

As disclosed in U.S. Pat. No. 4,909,142 which is hereby incorporated by reference as if fully reproduced herein, a Geneva stepping drive indexes the turntable and uses a driving motor, a speed reducer gear mechanism, a slotted wheel and a drive arm. All of this requires considerable space beneath the turntable. Since the column diameter is larger, a much larger vacuum box would be needed at the bottom of the column if one were to try to use the hollow space between the inner column and the outer rotating cylinder portion of the column. Thus, there was a need to eliminate such a large vacuum box and its space requirements and to eliminate the other problems, as above described, when using an annular cavity between an outer rotating cylinder and an inner stationary cylinder of a column supporting a large mass on a rotating turntable.

SUMMARY OF THE INVENTION

In accordance with the present invention, there is provided a vacuum distribution system for use in screen printing presses which provides a vacuum to hold printing articles securely to their respective vacuum beds during multiple printing operations. The vacuum distribution system of the present invention operates independently of the central support column and its cylinders. The above-mentioned shortcomings of prior designs have been eliminated in apparatus constructed in accordance with the present invention, with further advantages over prior designs attained as well.

The illustrated screen printing press of the present invention has a stationary, central vertical support about which a plurality of printing units are mounted in a stationary position. A turntable, which in turn supports a number of flat beds arranged about its periphery, is mounted for rotation about the central vertical support.

In accordance with a preferred embodiment of the present invention, a single stationary annular vacuum ring is secured in direct contact with the rotatable turntable, and centered about the central vertical support. The vacuum ring encircles the central support but is not in contact therewith. In the preferred embodiment, the vacuum ring has a U-shaped cross-section with its open end abutting the rotatable turntable. The vacuum ring is held against the turntable by the force of springs biasing the ring in that direction, so as to maintain a slidable airtight seal between the vacuum ring and the turntable as the turntable rotates.

The turntable has apertures therethrough which are spaced about the central support such that the apertures and the trough of the U-shaped vacuum ring are at generally equal radial distances from the vertical axis of the central support. Thus, regardless of the rotational position of the turntable, the apertures in the turntable are in registration with the trough of the vacuum ring. Vacuum hoses or conduit extend from each aperture in the turntable to the underside of its respective flat bed, and a stationary vacuum pump is attached to the vacuum ring.

The vacuum pump induces a vacuum throughout the vacuum ring which, in turn, induces a vacuum in each of the openings in the turntable, in the vacuum hoses or conduit attached thereto, and subsequently in the undersides of the corresponding flat beds or vacuum beds. Thus, regardless of the rotational position of the turntable, vacuums are maintained on the vacuum beds, thereby securing the materials to be printed on to their respective flat beds during multiple printing operations.

The present invention overcomes each of the previously-mentioned shortcomings of the prior art in a simple, inexpensive and reliable apparatus which lends itself to economical fabrication.

By placing the vacuum ring in direct contact with the turntable, and thereby eliminating utilization of the cavity between concentric cylinders for maintaining vacuum pressure, the present invention distributes vacuum pressure without the need for apertures in the central cylinder. This allows the central cylinder to support greater loads than believed attainable in the prior art. Also, since the central support of the present invention does not contain vacuum pressure therein, neither cracks in the central support nor non-airtight bearings present problems concerning loss of vacuum pressure.

The vacuum ring at the bottom of the turntable is relatively small and is located above the Geneva drive mechanism gear box and motor to index the turntable. Thus, a large vacuum box at the bottom of the column may be eliminated.

Additionally, the present invention eliminates the requirement of an airtight seal between the vacuum ring and the central support, which was previously believed necessary.

Furthermore, the design of the present invention eliminates the rotating plenum which was believed necessary in the prior art. Thus, cracks in the turntable no longer present problems concerning loss of vacuum pressure.

In addition to these advantages over the prior art, the apparatus of the present invention is able to attain the same vacuum pressure as prior art designs while utilizing a smaller overall cavity in which vacuum pressure is induced. Therefore, less time and energy are required to create sufficient vacuum pressure for operation than with previous designs. These savings in time and energy become quite substantial over long runs, wherein vacuum pressure is lost, and required to be induced again, upon each removal of material from its flat bed upon completion of its multiple printing operations.

Further advantages will become apparent as the description proceeds, and the features of novelty which characterize this invention will be pointed out with particularity in the claims annexed to and forming a part of the specification.

BRIEF DESCRIPTION OF THE DRAWINGS

In the drawings, wherein like elements are referenced alike,

FIG. 4 is an enlarged, elevational view of a vacuum ring constructed in accordance with the present invention;

FIG. 5 is a partial, cross-sectional view taken substantially along the line 5—5 of FIG. 3, looking in the direction of the arrows;

FIG. 6 is an enlarged, fragmentary view taken substantially along the line 6—6 of FIG. 4, looking in the direction of the arrows; and FIG. 7 is an enlarged, fragmentary view taken substantially along the line 7—7 of FIG. 4, looking in the direction of the arrows.

DETAILED DESCRIPTION OF THE PREFERRED EMBODIMENT

Figure 1:
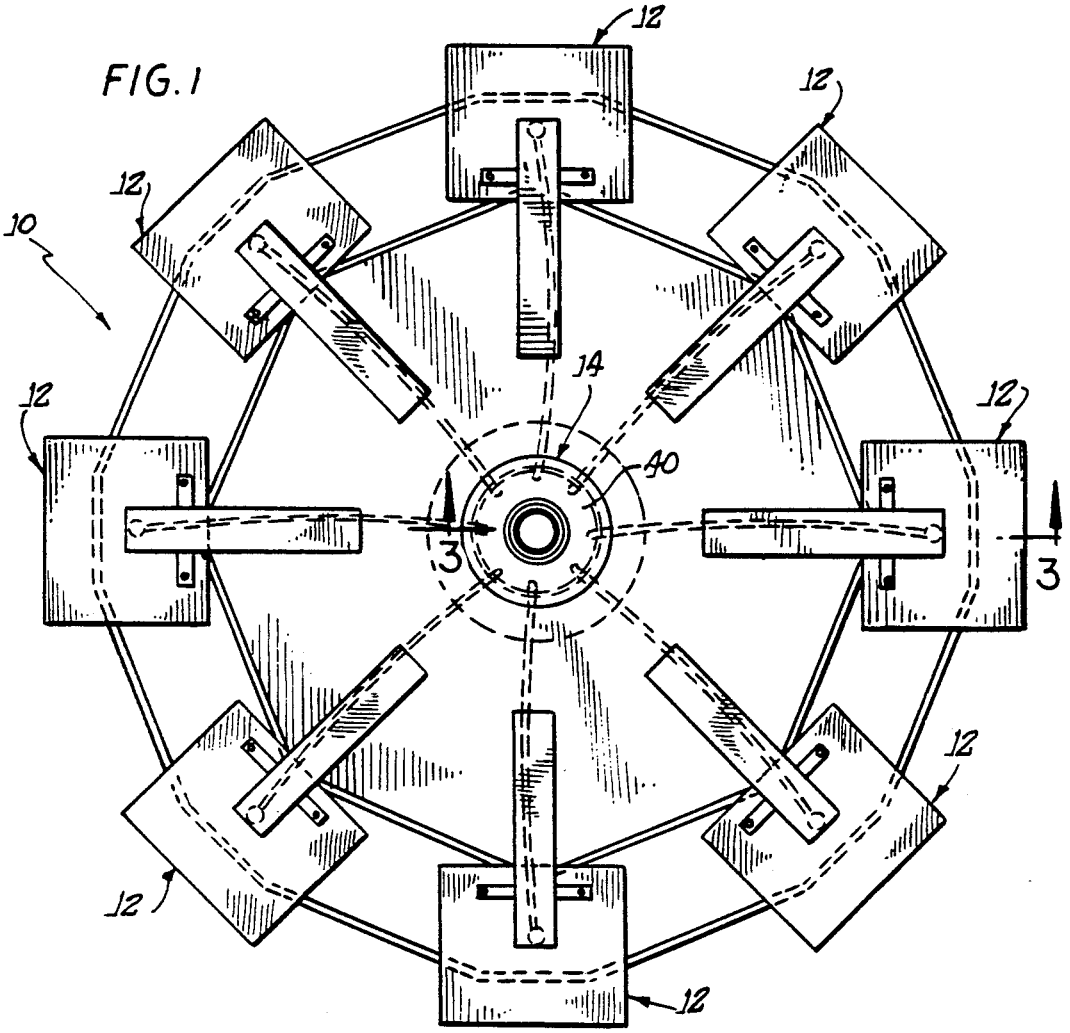
FIG. 1 is a plan view of a printing press arrangement with eight printing stations, embodying the present invention.
Figure 3:
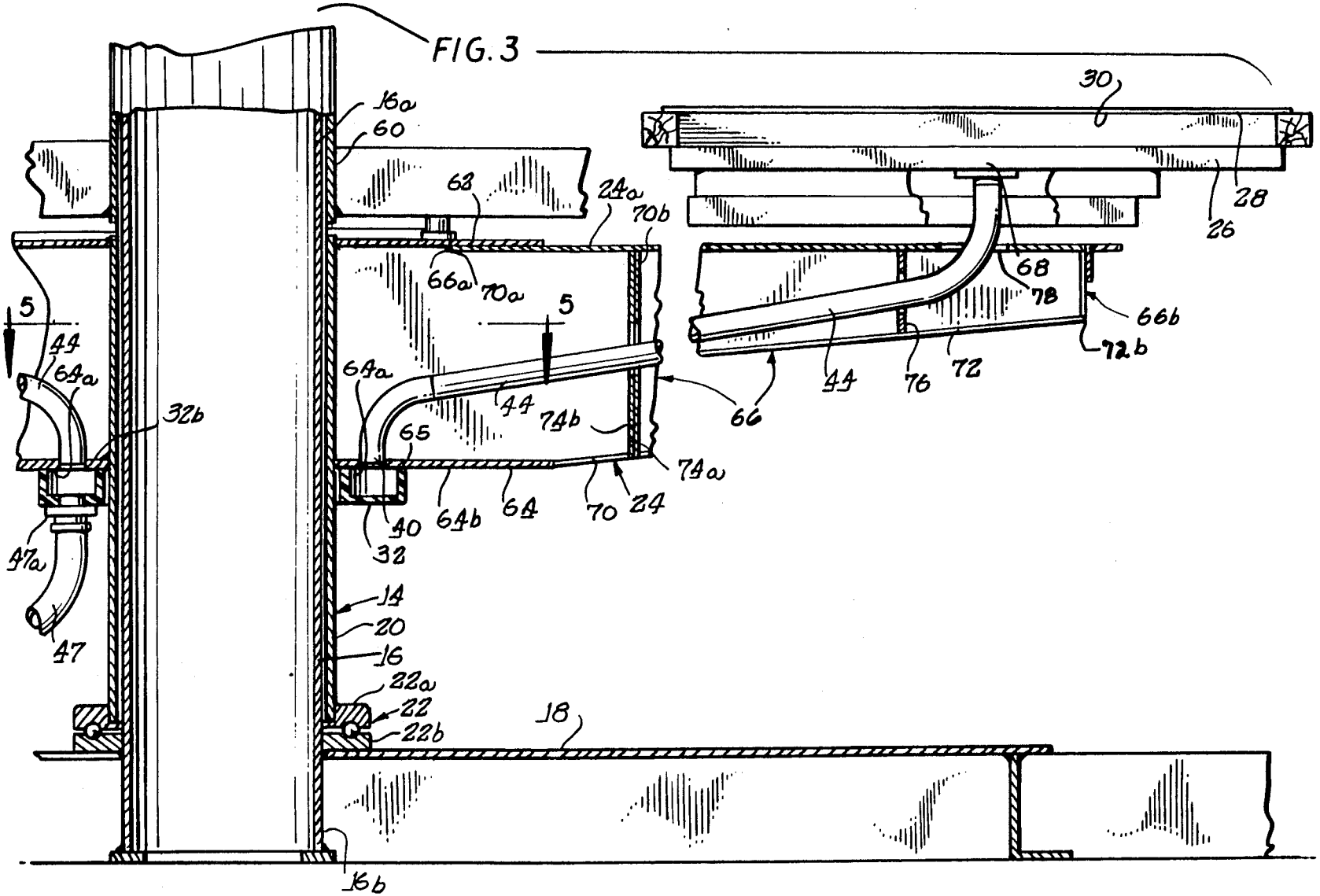
FIG. 3 is a fragmentary, cross-sectional view taken substantially along the line 3—3 of FIG. 1, looking in the direction of the arrows.

As shown in the drawings for purposes of illustration, the invention is embodied in a flat bed, screen printing press which may be of the kind disclosed in U.S. Pat. No. 4,909,142. Referring initially to FIG. 1, the printing apparatus indicated generally at 10 is illustrated to show eight printing units, indicated generally at 12, disposed in a stationary position about the upper end of a central support 14. As best seen in FIG. 3, the central support 14 consists of three right circular cylinders wherein an inner stationary column 16 is mounted to a base 18 in a stationary position. A lower, rotatable cylinder or sleeve 20 is mounted on a support bearing 22 for rotation about the lower end of the inner cylinder 16. An upper, stationary cylinder or sleeve 60 encircles the upper end of the inner cylinder 16 (see FIG. 3).

A turntable 24 for carrying a plurality of flat beds in a circular movement about the axis 21 by the column 16 is secured to the rotating lower sleeve or cylinder 20 so as to rotate therewith about the vertical axis 21 of the central column. The turntable 24 supports a plurality of flat beds 26 about its periphery. A Geneva drive mechanism (not shown) rotates the lower sleeve 20 about the vertical axis 21, thereby rotating each of the flat beds 26 into sequential registration beneath each of the stationary printing units 12. Material 28 to be printed on is placed upon the upper side of each of the respective flat beds 26 and sequentially transported to each of the printing units 12 whereat each printing unit prints a different color on the material 28. The images printed at the several printing units 12, when superimposed one over the other on the material 28, produce the desired multicolored product.

Due to the multiplicity of accelerations and decelerations and printing operations, the material 28 is held by a vacuum so that it will not be displaced slightly on the flat bed 26 between successive printing operations, resulting in inaccurate registration of successively printed colors. That is, in order to prevent the material 28 from being displaced during printing operations, a vacuum is applied to the underside 30 of the material 28 through the flat bed 26 upon which it rests.

In accordance with the present invention, the vacuum is drawn by the stationary vacuum pump 46 (FIG. 2) through its hose or conduit 47 which is connected to a non-rotating vacuum ring, which has sliding engagement at a seal 65 with a portion **64*a* of the rotating turntable. The portion 64*a* has a series of apertures 40 opening into the vacuum ring and a series of hoses or conduits 44 extending from the apertures to the respective flat beds 26**.

The vacuum ring is preferably in the form of an annular trough 42 having an upper open end **42*a* aligned with a series of apertures 40 in the flat rotating plate 64*a* on the turntable. The sliding seal 65 is achieved between the upper surface 32*b* of the annular ring and the lower surface 64 of the flat plate 64*a*. These surfaces 32*b* and 64*b* may be machined flat and made smooth to prevent leakage. Also, the surfaces may be urged together by a biasing means in the form of springs 38** to reduce air leakage at the sliding seal.

The preferred embodiment is illustrated in FIGS. 1 through 7. With initial reference to FIGS. 2 and 3, the vacuum ring 32 is shown to have a generally U-shaped cross-section with its open end surfaces **32*b* abutting the underside 64*b* of a flat plate 64 of the rotatable turntable 24. The vacuum ring 32 is held in a stationary position and held against the turntable 24 by the force of springs 38 (FIG. 2) biasing the ring 32 in that direction, so as to maintain a slidable airtight seal between the stationary vacuum ring 32 and the turntable 24** upon rotation of the turntable.

For the purpose of communicating the vacuum from the plenum of the ring to a series of vacuum conduits 44, as shown in FIGS. 3 and 5, the turntable 24 is provided with apertures 40 therethrough. The apertures 40 are spaced about the central support 14 such that the apertures 40 through the turntable and the trough 42 of the U-shaped vacuum ring 32 are at generally equal radial distances from the vertical axis 21 of the central support 14. Thus, regardless of the rotational position of the turntable 24, the apertures 40 in the turntable 24 are in registration with, or fluid communication with, the trough 42 of the vacuum ring 32.

The vacuum pump 46 is attached to the vacuum ring 32 via the pump hose 47 so as to induce vacuum pressure throughout the vacuum ring 32 and, accordingly, in the apertures 40 in the turntable.

Finally, to distribute the vacuum pressure from the apertures 40 in the turntable to the flat beds 26, the plurality of vacuum conduits 44 is employed preferably in the form of hoses each of which extends from an inner end connected to an aperture 44 in the flat plate 64 of the turntable to an aperture in the underside of a respective flat bed 26 located at the periphery of the turntable 24. Thus, the vacuum pump 46 induces a vacuum throughout the vacuum ring 32 which, in turn, induces a vacuum simultaneously in each of the apertures 40 in the turntable, in the vacuum conduits 44 attached thereto, and subsequently in the undersides of the corresponding flat beds 26. Thus, regardless of the rotational position of the turntable 24, vacuum pressure is maintained in each of the flat beds 26, thereby securing the materials 28 to be printed to their respective flat beds 26 during multiple printing operations.

As shown in FIG. 4 and in cross-section in FIGS. 6 and 7, the vacuum ring 32 is annular and preferably of U-shaped cross-section. That is, the inner sidewall 48 and outer sidewall 50 of the vacuum ring 32, together with the bottom wall 52, define the trough 54. The trough 54 allows vacuum pressure to be distributed simultaneously to each of the apertures 40 in the turntable 24.

Referring to FIG. 4, the bottom surface 52 of the vacuum ring 32 contains a vacuum port 56 therethrough, to which one end of a pump hose 47 is attached. The vacuum port 56 is preferably located approximately midway between the inner sidewall 48 and outer sidewall 50 of the vacuum ring 32. The diameters of both the vacuum ring 32 and the vacuum port 56 will vary depending upon the particular design and operating characteristics selected; however, the vacuum ring 32 and vacuum port 56 should be of sufficient diameter to allow a flow of air ample to maintain vacuum pressure at the flat beds 26.

Figure 2:
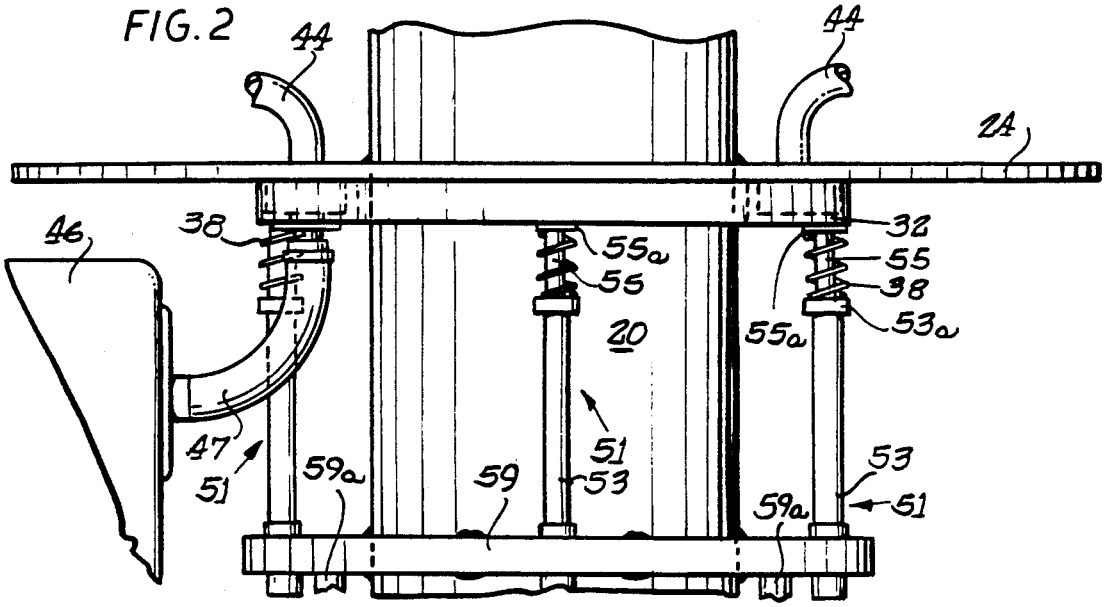
FIG. 2 is an enlarged, fragmentary side view of the embodiment shown in FIG. 1, particularly illustrating the vacuum ring support arrangement.

Suitable flanged fittings **47*a* connected the upper ends of the vacuum hose 47 to the underside of the annular ring. As best seen in FIG. 2, the annular ring 32 is supported on the upper ends of vertical supports 51 which also support the springs 38. The vertical supports 51 include a lower hollow cylinder 53 having a telescoping shaft 55 slidable in the hollow cylinder. The springs 38 are positioned between an upper flange 53*a* on the stationary cylinder 53 and an upper flange 55*a* on the telescoped shaft which flange is secured to the underside of the ring. Thus, the compressed springs 38 push the upper flange 55*a* and attached shaft upward at each of a plurality of locations about the ring to provide a balanced upward thrust to keep the sliding seal surfaces engaged. The vertical supports 51 are mounted on a lower support plate 59 which is supported by stationary vertical legs or frame members 59***a*. These, frame legs may be connected to the floor, the frame or stationary parts of the Geneva drive mechanism. Both the vacuum ring and the support plate have inner opening of a larger diameter than that of the rotating cylinder 20. Thus, the vacuum ring is supported for shifting vertically but is non-rotatable.

As shown in FIG. 3, the turntable 24 has a plurality of spider arms 66 which extend generally radially outward from the central support 14. The spider arms have a proximal end 66*a* near the central support 14, and a distal end 66*b* away from the central support. Each spider arm 66 carries a respective flat bed 26 near its distal end 66*b*. Vacuum conduit 44 extends through each spider arm 66, from the aperture 40 in the turntable 24 to the flat bed 26 at the distal end 66*b* of the spider arm. This is explained in more detail below.

The turntable 24 and printing units 12 are supported by a central support 14, which consists of an inner stationary cylinder 16, lower sleeve 20, and upper sleeve 60. With reference to FIG. 3, in the preferred embodiment the inner stationary cylinder is an inner right circular cylinder 16 which is mounted by weldment or the like to a base 18 in a stationary vertical position. The base 18 should be of sufficient lateral width to prevent the tipping over of the central support 14 due to forces acting thereon, and should be of sufficient strength to withstand the heavy vertical loads required to be supported by the central support 14.

As disclosed in previously-mentioned U.S. Pat. No. 4,909,142, the printing units 12 are attached to an upper collar or sleeve 60 which is mounted in a stationary position about the upper end 16*a* of the inner cylinder 16 by weldment or the like. Thus, a plurality of printing units are circumferentially-spaced about the upper end 16*a* of the inner cylinder 16 and maintained in a stationary position above the plurality of rotating flat beds 26. That is, the flat beds 26 are attached about the periphery of the turntable 24 which rotates about the lower end 16*b* of the central cylinder 16, thereby carrying each of the flat beds 26 into sequential registration beneath each of the printing units 12. Upon each successive registration, the material 28 mounted on the flat bed undergoes one of its printing operations.

To provide for rotation of the flat beds 26 into registration beneath the printing units 12, the lower sleeve 20, which supports the turntable 24 and flat beds 26 mounted thereto, is mounted for rotation about the lower end 16*b* of the inner cylinder 16. The lower sleeve 20 is mounted on a roller bearing 22 which is concentric with the central support 14 such that the lower sleeve is concentric with the inner cylinder 16 and rotatable about the lower end 16*b* of the inner cylinder. The upper race 22*a* of the roller bearing 22 is welded to the bottom of the lower sleeve 20, and the lower race 22*b* is mounted to the base 18, thus allowing for rotation of the lower sleeve upon roller bearing 22. Air will leak through this lower bearing 22 if it were used in a system in which a vacuum chamber was formed between the inner column 16 and the outer rotating sleeve 20.

In the embodiment shown in FIG. 3 the turntable 24, which supports the flat beds 26 about its periphery, is comprised of three components: two annular plates 62 and 64, and spider arms 66. The two plates, 62 and 64, are welded to the rotatable lower sleeve 20 and serve to support the remainder of the turntable 24 and the flat beds 26 attached thereto, as discussed below.

The plates, 62 and 64, are centered about the vertical axis 21 of the central support 14, oriented perpendicularly to the vertical axis 21, and spaced axially from one another along the vertical axis.

In order to provide space for the drive mechanism (not shown) beneath the turntable 24, the two plates 62 and 64 supporting the remainder of the turntable are welded to the lower sleeve 20 at the upper end thereof. Thus, the turntable 24 is affixed to the lower sleeve 20 near its upper end 20*a*, thereby allowing ample room between the base 18 and turntable 24 for large drive mechanisms.

The two plates, 62 and 64, consist of an annular center plate 62 which is welded to the lower sleeve 20 at the upper end 20*a* thereof, and an annular plate 64 which is welded to the lower sleeve 20 at a location spaced axially from the center plate 62. Thus, there are two parallel plates which are welded about the upper end of the lower sleeve 20 which serve to provide support for the remainder of the turntable 24, and the flat beds 26 mounted thereto.

In further accordance with this particular embodiment, the remainder of the turntable comprises a plurality of spider arms 66 extending radially outward from the lower sleeve 20. The spider arms are spaced symmetrically about the vertical axis 21 so as to impose a more uniform load upon the central support 14. FIG. 1 depicts a printing apparatus having eight such spider arms 66, however it will be readily apparent to those skilled in the art that turntables constructed in accordance with the present invention may have any number of spider arms.

As illustrated in FIG. 3, each spider arm 66 is mounted in cantilever fashion with a proximal end 66*a* of each spider arm 66 positioned between and attached to the parallel plates 62 and 64, and a distal end 66*b* of each spider arm 66 unsupported. Thus, as the lower sleeve 20 rotates about the vertical axis 21 of the central support, supported by the bearing 22, the turntable 24 with its associated spider arms 66 also rotates about the vertical axis 21 of the central support 14.

The embodiment shown in FIG. 3 depicts spider arms 66 comprised of two components 70 and 72. A C-shaped channel piece 70 has an open proximal end 70*a* which extends between and is attached, by weldment or the like, to both the center plate 62 and a plate 64 so as to extend radially outward from the lower sleeve 20. A channel arm 72 is attached to the distal end 70*b* of the channel 70 such that the spider arm 66 extends further in the radial direction. The channel arm 72 has an aperture 78 through its upper surface 24*a* at a location near its distal end 72*b*. The aperture 78 through each channel arm 72 is aligned with the aperture 68 through each respective flat bed 26 which rests on that channel arm, so as to provide an airtight path between each flat bed 26 and the associated channel arm aperture 78. The distal end 70*b* of the channel 70 has an end plate 74*a* portion which extends generally vertically between the upper and lower ends of the channel 70. The channel arm 72 has an end plate 74*b* at its proximal end 72*a*. The channel 70 and channel arm 72 are attached to one another by weldment or the like of the two end plates 74*a* and 74*b*.

The channel arm 72 is provided with reinforcing members 76 which extend generally vertically between the upper and lower surfaces of the channel arm to provide additional structural support. The number and location of such reinforcing members 76 will vary with the size and load parameters chosen for the printing apparatus 10. Both the end plates, 74*a* and 74*b*, and reinforcing members 76 have apertures therethrough to allow for passage of vacuum conduit 44 as discussed further, below.

As shown in FIG. 3, the upper surface 24*a* of the composite spider arms 66 should be positioned horizontally and be smooth and continuous, particularly at the location at which the channel 70 and channel arm 72 meet. The spider arms 66 taper down from the proximal end 66*b* of the spider arm to the distal end 66*b*. More specifically, the lower surface 24*b* tapers gradually toward the horizontal upper surface 24*a* of the turntable 24. The width of the spider arms 66 remain generally 25 uniform between the proximal ends 66*a* and distal ends 66*b* thereof. Both the channel 70 components and channel arm 72 components taper down from their proximal end to their distal end such that when the channel 70 and channel arm 72 are connected, a smooth and continuous spider arm 66 results.

Having described the general construction and support of the turntable 24 and spider arms 66, discussion of the vacuum distribution characteristics of printing apparatus 10 constructed in accordance with the present invention will now be resumed.

In order to provide for distribution of vacuum pressure to the flat beds 26, a stationary vacuum ring 32 is positioned beneath the rotating turntable and includes a lower plenum trough portion in fluid communication with a plurality of circumferentially-spaced holes or apertures 40 in an upper rotating portion of the turntable. The apertures 40 correspond in number and location to the number and location of spider arms 66. The apertures 40 in the rotating turntable plate portion 64*a* are spaced radially from the vertical axis 21 at approximately the same distance as the trough portion 42 of the vacuum ring 32. Thus, regardless of the rotational position of the turntable 24, each of the apertures 40 is in fluid communication with the trough 54 of the vacuum ring trough 54 which has sealed sliding contact with the plate portion 64*a* on the turntable, as discussed above.

To distribute the vacuum pressure from the apertures 40 in the rotating plate 64 to the flat beds 26, a series of vacuum conduits 44 are employed. See FIGS. 1, 3 and 5. At least a portion of each spider arm 66 is hollowed out, or a passageway provided therethrough, to accommodate passage of vacuum conduit 44 from the aperture 40 to the aperture 78 in the distal end of the spider arm 66. One end of each vacuum conduit 44 is attached to one of the apertures 40 in the plate 64, with the other end of each conduit attached to the aperture 68 in the respective flat bed 26.

Vacuum pressure is thereby distributed from the non-rotatable vacuum ring 32, through the apertures 40 in the rotating plate 64, through the rotating turntable 24 via the vacuum conduit 44, and subsequently through the apertures 68 in the flat beds 26. The vacuum pressure in the flat beds then acts to secure material 28 to the flat beds 26 during printing operations, regardless of the rotational position of the turntable 24 and spider arms 66.

The operation of a printing apparatus 10 constructed in accordance with the present invention will now be described through one cycle. Material 28 which is to be printed on is placed upon each of the flat beds 26. Thereafter, the vacuum pump 46 is turned on. This induces vacuum pressure in the flat beds 26, and the underside of the material to be printed on. The pressure differential between the ambient pressure on the top side of the material 28 and the vacuum pressure on the underside of the material 28 holds the material 28 to be printed on securely to the flat bed.

It may be desirable to employ a vacuum pump 46 capable of two operating pressures. In such an embodiment a first, lower vacuum pressure is maintained in the flat bed by the pump sufficient to hold the material 28 against the flat bed, while still allowing for manual adjustments for precise positioning of the material. After each of the materials 28 to be printed on are positioned precisely upon their respective flat beds 26, the vacuum pump 46 is then switched to a second, higher vacuum pressure sufficient to prevent substantially any movement of the materials upon their respective flat beds.

The drive mechanism (not shown) then rotates the turntable 24 with its associated spider arms 66 until each of the flat beds 26 mounted thereto, and materials 28 to be printed on, are in registration beneath the desired printing units 12. The printing units 12 then go through their respective flood and stroke cycles, thereby each unit printing one color of the desired composite image upon the material in registration therewith.

The drive mechanism then rotates the turntable 24 with its associated spider arms 66, and the each of flat beds 26 mounted thereto, such that each of the flat beds are in registration with the next adjacent printing units. The printing units again go through their respective flood and stroke cycles thereby printing a second color upon each of the materials 28. This continues until each of the materials 28 to be printed on has undergone the desired number of multicolor printing operations. Normally, this would occur after each of the flat beds 26 has been in registration with each of the printing units 12 one time. However, it is foreseeable that in some instances it may be desirable to print less than the maximum number of possible colors, or to have each material with a different composite image than the other materials for that given cycle of operation. Vacuum pressure is maintained in the flat beds throughout the printing operations by the vacuum ring 32 in constant fluid communication with each of the flat beds 26.

After the materials 28 have undergone the desired number of printing operations, the vacuum pump 46 is turned off thereby essentially eliminating the vacuum pressure in the flat beds 26, and the materials 28 are removed from their respective flat beds 26. New materials 28 to be printed on are then placed upon the empty flat beds 26, and the cycle repeats itself.

While the above-described invention has the printing units mounted on the column above the flat beds, it is possible to have the printing units separate from the flat beds or platens and mounted on separate detached stands located about the circumference of the turntable, as disclosed in U.S. Pat. No. 4,724,760. Also, while the vacuum beds have been described as flat beds to hold flat material such as sheets or textiles, the vacuum beds could be curved to hold bottles or the like.

While the invention has been described with reference to a preferred embodiment, it will be understood to those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for screen printing, comprising:

an inner stationary column having a vertical axis, an outer rotatable cylinder encircling the inner stationary column and rotatable about the vertical axis, a rotatable turntable mounted on the rotatable cylinder for turning in a circular path about the vertical axis to move between successive stations, a plurality of screen printing means for printing on an object at each of the successive stations, a plurality of work supports on the turntable spaced circumferentially about the turntable and having a vacuum bed for retaining a workpiece, a plurality of vacuum conduits extending from each vacuum bed toward the rotatable cylinder, a stationary vacuum means for inducing a vacuum, and a vacuum ring means having slidable sealed contacting surface with the turntable and being connected to the vacuum means to transfer the vacuum to the plurality of conduits on the turntable and thereby to the work supports.

2. An apparatus in accordance with claim 1 in which the vacuum ring has a central plenum chamber trough and the turntable has a rotatable plate having a plurality of apertures aligned with the rotatable trough, and connected to the vacuum conduits, to transfer the reduced pressure to the vacuum conduits.

3. An apparatus in accordance with claim 2 in which a biasing means biases the vacuum ring against the rotatable plate to assist in the sliding seal being air tight.

* * * * *